United States Patent [19]

Fisher

[11] Patent Number: 4,830,206

[45] Date of Patent: May 16, 1989

[54] TAMPER RESISTANT CONTAINERS

[76] Inventor: William Fisher, 406 New York Ave., Manitowoc, Wis. 54220

[21] Appl. No.: 241,037

[22] Filed: Sep. 6, 1988

Related U.S. Application Data

[63] Continuation-in-part of Ser. No. 170,309, Mar. 3, 1988.

[51] Int. Cl.[4] ..... B65D 55/02

[52] U.S. Cl. ..... 215/209; 215/211; 206/1.5

[58] Field of Search ..... 215/209, 211, 216; 206/1.5

[56] References Cited

U.S. PATENT DOCUMENTS

| | | | |
|---|---|---|---|
| 3,101,856 | 8/1963 | Whiteman, Jr. . | |
| 3,360,147 | 12/1967 | Schaefer . | |
| 3,399,764 | 9/1968 | Rigor . | |
| 3,828,961 | 8/1974 | Lewis . | |
| 3,868,036 | 2/1975 | Wittwer . | |
| 3,907,103 | 9/1975 | Shaw . | |
| 3,912,073 | 10/1975 | Lewis . | |
| 4,278,178 | 7/1981 | Geiser | 215/215 |
| 4,355,729 | 10/1982 | Maguire | 215/211 |
| 4,393,976 | 7/1983 | Maguire | 215/211 |

*Primary Examiner*—George T. Hall

*Attorney, Agent, or Firm*—Jacobson and Johnson

[57] ABSTRACT

A tamper resistant container that can be readily opened by an elderly person but is difficult for a young child to open comprising a container for holding toxic substances with the container having a latch lip for engaging a cover and a pressure region located at the top of the container and over the latch lip, and a cover for engaging the container to close and seal toxic substances in the container with the container including a slip ring to permit free rotation of the container when the cover on the container is rotated to thereby thwart a young child from opening the tamper resistant container with the cover including a cylindrical lip to latch the cover to the container with the cylindrical lip operable for disengagement of the cover with the container by the user squeezing on a specific region on the outside of the container so that the container flexes inward to disengage the cylindrical lip from the container to thereby permit the user to remove the cover from the container.

14 Claims, 7 Drawing Sheets

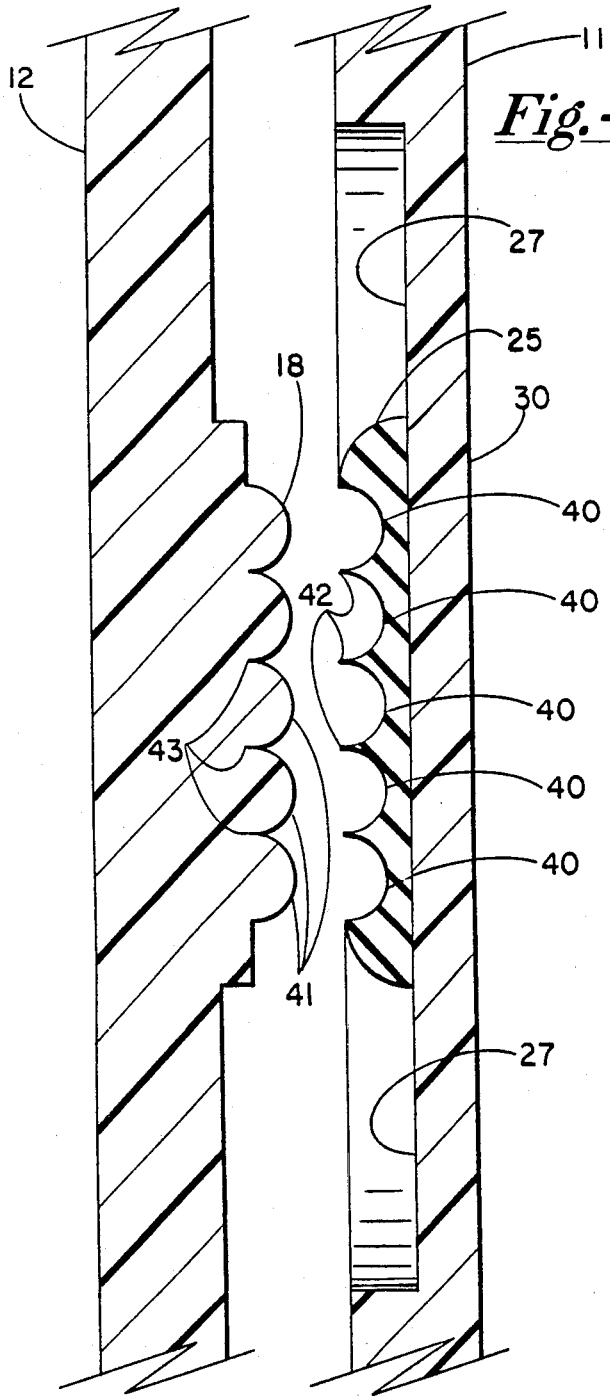
Fig.-19
Fig.-20
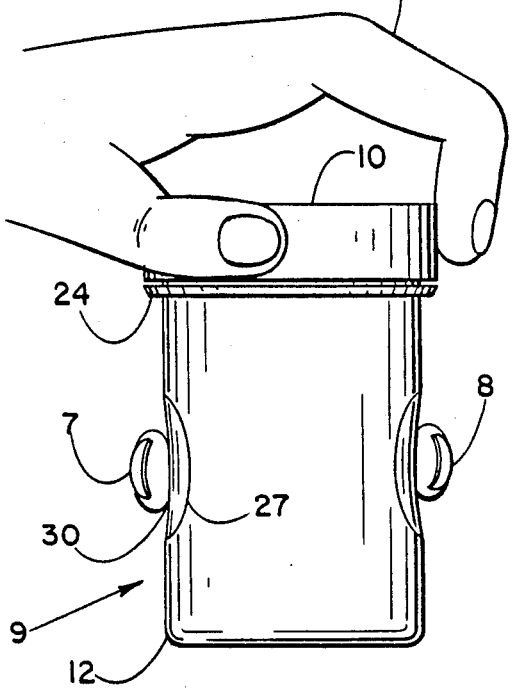

TAMPER RESISTANT CONTAINERS

CROSS REFERENCE TO RELATED APPLICATIONS

This application is a continuation-in-part of my copending application titled TAMPER RESISTANT CONTAINERS, serial No. 170,309 filed Mar. 3, 1988.

FIELD OF THE INVENTION

This invention relates generally to tamper resistant containers and, more specifically, to a container that can be readily opened by the elderly yet can not be opened by young children.

BACKGROUND OF THE INVENTION

The concept of tamper resistant or safety containers is old in the art. The need for safety containers arose because each year many children die from accidentally ingesting prescription or nonprescription medicine. To avoid unnecessary death of children, container manufacturers have made containers that are difficult for children to open. Unfortunately, the containers have also been difficult for the elderly to open. Consequently, the elderly have been forced to leave the medicine container uncapped or to place the medicine in other containers that were not child-proof. As a result the safety containers, although effective in preventing children from opening the containers, become ineffective since the elderly oftentimes cannot use them. Thus a need exists for a safety container that is usable by the elderly yet prevents children from opening the container. Because the muscles in the elderly deteriorate from nonuse and age, it is difficult to make a tamper resistant container that the elderly can readily open. The present invention utilizes the muscles in the elderly that are used on a daily basis for such activities as eating, writing, and picking up items. One such set of muscles that are used on a daily basis are the muscles of the finger and thumb that are used to grasp objects.

In my copending application (Ser. No. 170,309) I disclose an invention that provides a tamper resistant or safety container that permits the elderly person with diminished physical coordination, strength, and skill to open the container yet still prevents young children from opening the container. The invention disclosed in my copending application has an inner container and an outside container that permits an elderly person to use the well established conventional motor skills used in opening a screw top container yet because of the requirement that container needs to be grasped and held in a particular manner and at specific regions on the container virtually precludes young children from being able to open the container. The embodiments of my copending application with the inner and outer containers are illustrated in FIGS. 11–20.

In the invention described in my copending application four motions occur at the same time. With one hand the user grips the outer container and applies pressure at specific regions on the container and with the other hand the user grips and turns the cap. The functions required to open the container are divided between both hands which is better for an elderly person who may lack sufficient hand strength to perform more involved steps that require exertion of unusual force with one hand and very little force with the other. The invention permits the elderly to use a more comfortable hold and squeeze motion rather than a squeeze and turn motion found in prior art safety containers. In addition very little torque is required to open the container since the cover mates with the container in a conventional manner. Also, because of the natural way the hand is placed on the container the squeezing motion is easier to apply to the container than it is with prior art devices that require the cap to be squeezed and turned at the same time.

The present invention uses the same motor skills with a single container having a slip ring and a cover that can be lifted off or turned off by an elderly person yet is difficult for a youngster to remove the cover.

DESCRIPTION OF THE PRIOR ART

The Rigor U.S. Pat. No. 3,399,764 shows a medicine bottle with an inner and outer container with a magnet located on the bottom of the inside container and on the bottom of the outside container. When the poles in the magnets are in opposite position the magnets hold the inner container inside the outer container. By rotating the inner container a half turn the magnets are placed in a repelling mode which forces the inside container partially outside of the outside container thereby permitting the user to grasp and remove the closure on the inner container. Generally, such type of containers are difficult for the elderly to open since not only is it an unconventional opening technique but it also requires one to align markings that may be hard for the elderly to see.

The Shaw U.S. Pat. No. 3,907,103 shows a rectangular safety container having a hinged lid and latches which are released by squeezing on the walls of the container to release the latches. Each of the opposite sidewalls must be squeezed to open the lid on the container. This type of container suffers from the disadvantage that it requires the elderly to learn a new procedure before the container can be opened and in addition it is sometimes difficult for the elderly person to see that the first squeezing motion was sufficient to partially open the lid.

The Whiteman U.S. Pat. No. 3,101,856 shows a bottle closure having ratchet teeth that engage the container to prevent unscrewing the closure unless the user also squeezes on the container to disengage the ratchet teeth on the closure from the container. Such containers require the user to apply and hold pressure on the side of the container to disengage the teeth on the cap from the teeth on the container. Whiteman points out that the use of stiff material requires strength not found in young children. Unfortunately, elderly people also often lack the strength to open such a container. In addition the container requires the user to place their fingers in an unnatural position for opening a container.

The Wittwer U.S. Pat. No. 3,868,036 shows a closure that must be squeezed along the rib area to bring the outer cover into engagement with the inner cap to permit rotation of the inner cover. This container suffers from the disadvantage that it requires the user to squeeze harder than normal to open the container.

The Schaefer U.S. Pat. No. 3,360,147 shows a safety container that uses a ratchet tooth cap and a bottle that is squeezed to disengage the ratchet teeth from the container. The Schaefer patent is similar to the Whiteman in that both require the user to apply high hand pressure to squeeze the container to disengage the cap from teeth located on the container.

The Lewis U.S. Pat. No. 3,912,073 shows a safety container having an inner container and an outer sleeve with wells that must be in engagement with tabs before the container can be opened.

The Lewis U.S. Pat. No. 3,828,961 shows a similar container that has a circumferential rib to hold the cover on the container.

SUMMARY OF THE INVENTION

Briefly, the invention comprises a tamper resistant container for holding articles having a cover that is freely rotatable within an outer container unless specific regions on the outside of the container are squeezed to release a hidden latch that prevents removal of the cover from the container. The pressure points on the container have been found to permit the elderly to squeeze the container and remove the cap even though their physical strength may be diminished since the motor skills required to open the container are the same motor skills that the elderly have previously used to open containers with screw-on covers. In addition, children have difficulty in performing the squeezing and holding action since it requires a use of small motor movement skills that are not fully developed in children. Because the latch is hidden and in one embodiment requires squeezing on two locations of the container, a young child observing someone opening the container cannot readily determine how the user opened the container. Oftentimes the young child believes that the container is "magical" and doesn't attempt to figure out how to open the container. In one embodiment the invention also includes a set of teeth on the container that permits free rotation in one direction but prevents free rotation of the cover with respect to the container when the user is tightening the cover on the container.

BRIEF DESCRIPTION OF THE DRAWINGS

FIG. 19 shows an enlarged view of the friction pad and the brake on the inside container; and FIG. 20 shows a user's hands opening the tamper resistant container.

DESCRIPTION OF THE PREFERRED EMBODIMENT

Figure 1:
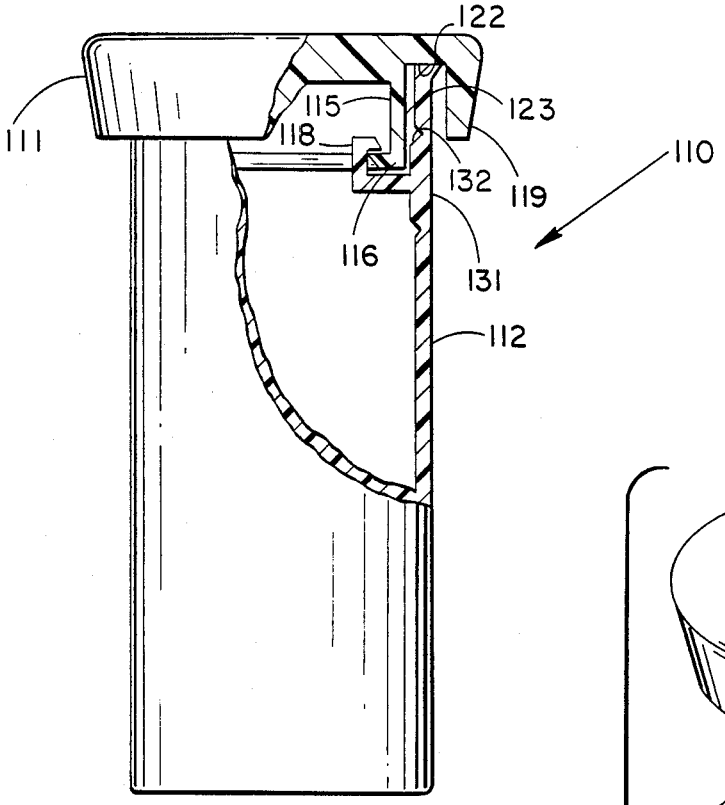
FIG. 1 is a side sectional view of my safety container in an assembled condition.
Figure 2:
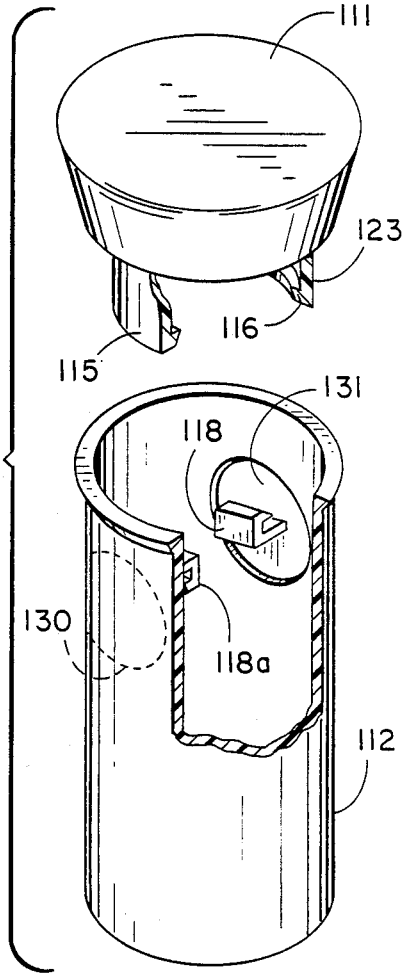
FIG. 2 is an exploded view of my safety container.

Referring to FIG. 1 and FIG. 2 reference numeral 110 identifies one embodiment of my invention that uses a snap-on lid and a hidden latch. Safety container 110 comprises a cover 111 and an outside container 112 . Cover 111 includes a latch comprising an inner cylindrical slip skirt or ring 115 that extends partially into the top of container 112. The use of a slip skirt that extends partially into container 112 rather than a separate inside container greatly reduces the amount of material necessary to make my improved safety container and provides a simple-to-use container that does not require an inner container or sleeve to confine the medication. Slip skirt 115 has an annular lip 116 that forms latching engagement with a first lip latch 118 and a second identical lip latch **118*a* that attach to diagonally opposite regions on the interior of container 112. Cover 111 also includes an outside cylindrical skirt 119 that extends partially over the top of container 112. Container 112 includes a cylindrical top lip 122 that extends out as a reinforcement ring for top of container 110. The use of reinforcement lip ring 122 permits my outside container pressure areas 131 and 130 to be located proximate the top of my container. That is, with reinforcement lip 122 located on the top of my container it prevents undue deformation of the container into an oval shape as the pressure regions 131 and 131*a* are squeezed. In some instances the reinforcement ring 122 can be incorporated directly into the container wall. The lip 122 or top portion of container provides sufficient support so that finger pressure on pressure regions 130 and 131 deflects latch 118 and 118*a* radially inward to permit disengagement of the latching means and permit vertical upward removal of lip 116 of cover 111 from lip latches 118 and 118*a*. Located on the outside of container 111 is a cylindrical band 123 of a bright, highly visible, material such as fluorescent red that is completely covered by skirt 119 when safety container 110 is in the closed and latched condition. If the safety container 110 is not in the closed and latched condition the appearance of the bright band 123 as a visual alarm to alert the user that cover 111 is not secure to container 112**.

Figure 3:
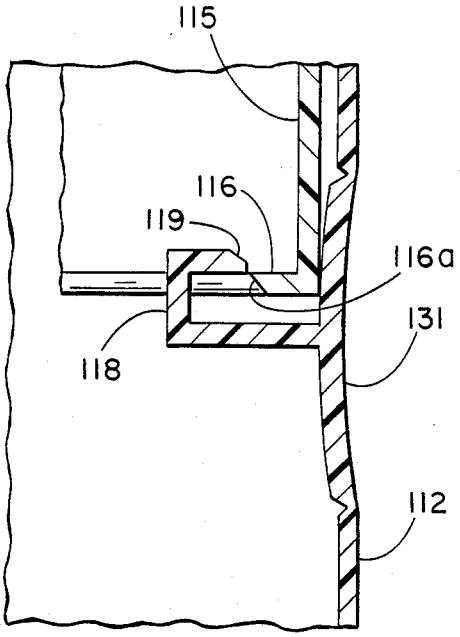
FIG. 3 shows a side sectional view of my safety container with the sides of the container releasing the latch on the inner member.

Located on one side of container 112 and directly over lip latch 118 is a first external pressure region 131. Similarly, located on the opposite side of container 112 is a second identical external pressure region 130 having an identical lip latch **118*a* attached thereto. Pressure region 131 is defined by an oval groove 132 that extends into container 112 to provide a weakened area around pressure region 131 to permit a user to flex pressure region 131 inward in response to finger pressure as shown in FIG. 3. The inward pressure on container 112 at pressure region 131 causes annular lip 116 to disengage from annular lip latch 118. Similarly, inward pressure on container 112 at pressure region 130 causes an identical lip latch 118*a* beneath pressure region 130 to disengage annular lip 116. Once the annular lip 116 disengages from the lip latches the user grasps the edge of cover 122 that projects outward for easy grasping by an elderly person. Using the conventional motion to remove a screw on cover the person simply lifts up on cover 111 to remove cover 111 and expose the contents of container 112** to the user.

To close safety container 110 the user merely inserts cover 111 in container 112 and pushes down on cover 111 until annular lip 116 forces itself past resilient latch lips 118 and 118*a* that deflect inward to permit annular lip 116 to engage the latch lips located on the inside of the container 112. In this embodiment cover 111 can turn freely in single container 112 without cover 111 being removed thus making it more difficult for a child to figure out. Latch lip 118 has a beveled surface 119 and lip 116 has a similar beveled surface 116*a* that coact to permit latch lips 118 and 118*a* and lip 116 to slide past each other in one direction but not in the opposite direction.

Figure 4:
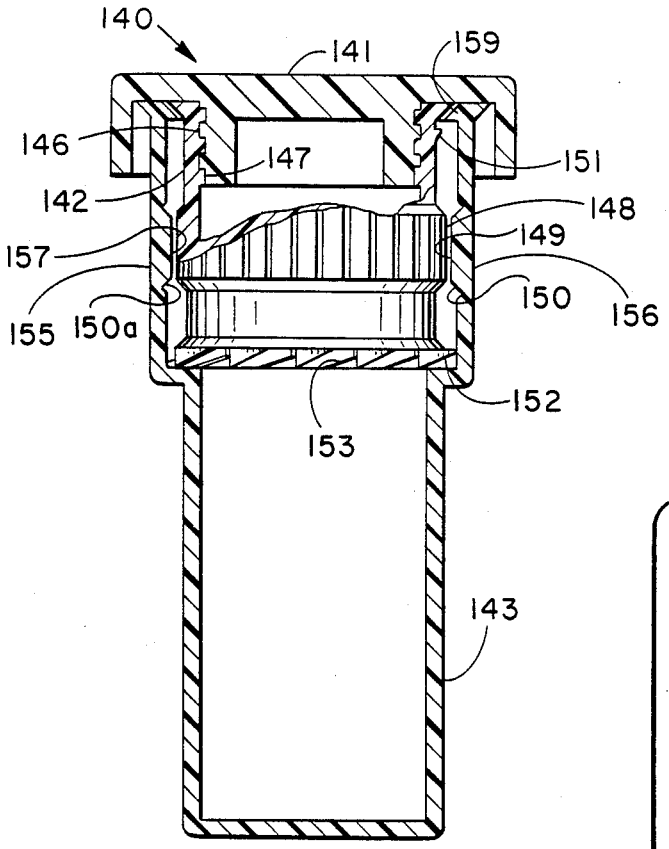
FIG. 4 shows a partial side sectional view of an alternate embodiment my safety container.
Figure 5:
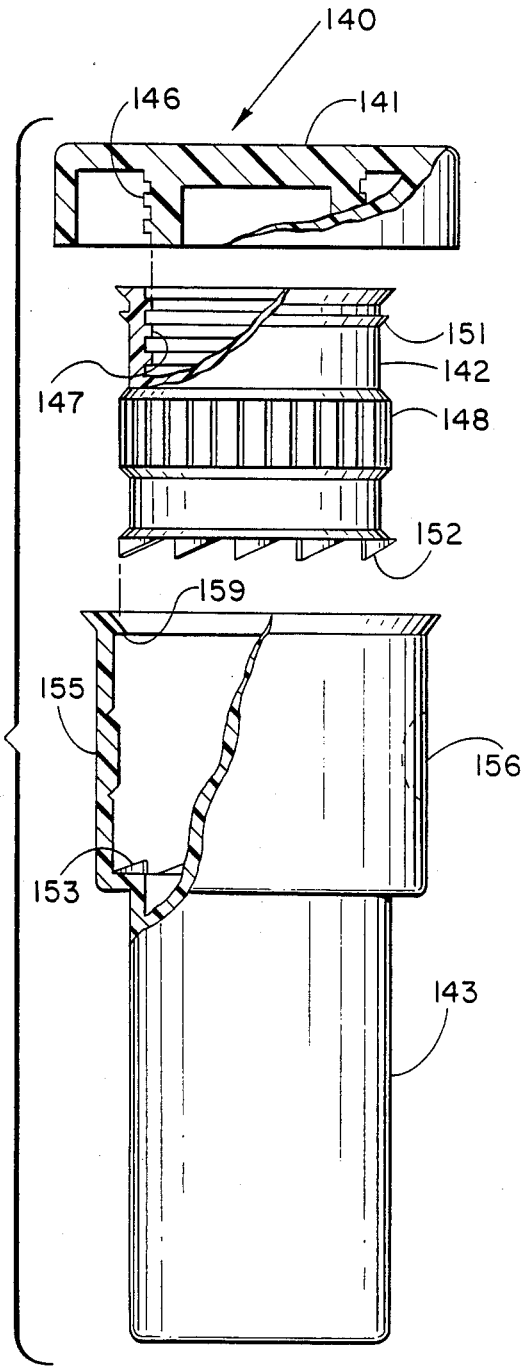
FIG. 5 is an exploded view of the the container of FIG. 4 showing the teeth on a sleeve that permits rotation in one direction and prevents rotation in the opposite direction.
Figure 6:
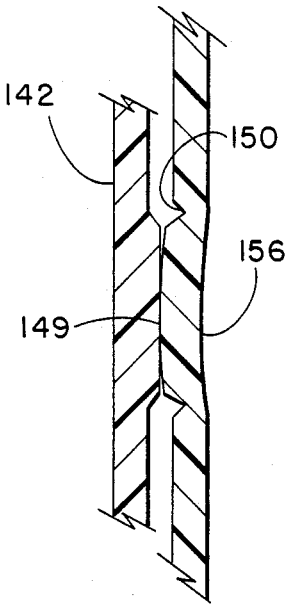
FIG. 6 shows the sleeve engagement member.

Referring to FIG. 4, FIG. 5, and FIG. 6 there is shown an alternate embodiment of my safety container 140 that uses an interior brake to hold an interior cylindrical slip skirt 142 from rotating to permit removal of a screw on cover 141 from safety container 140. To assemble safety container 140, one pushes slip ring or slip skirt 142 downward until it snaps into housing 143. That is, annular lip 151 and annular lip 159 have tapered ends that deform resiliently as they slide downward past each other yet engage each other to prevent withdrawal of cylindrical slip skirt 142.

Safety container 140 comprises a screw-on cover 141 having threads 146 for engaging similar threads 147 located on slip skirt 142 and a container bottom 143. Slip skirt 142 extends partially into the top of container bottom 143 to minimize the amount of material needed to make safety container 140 and to provide a safety container that does not require a separate container or sleeve to confine the medication. Slip skirt 142 includes an annular retaining lip 151 and an annular friction pad 148 for engaging friction pads located on the interior of container 143. FIG. 5 shows an exploded view and FIG. 4 shows an assembled view with cover 141, sleeve 142 and container 143 in a closed condition. Slip skirt 142 is held in a rotatable relation within container 143 by a resilient lip 151 that engages lip 159 on the interior of container 143. To permit rotation of slip skirt 142 in only one direction slip skirt 142 is provided with a set of annular teeth 152 that engage annular teeth 153 on container bottom 143 when the slip skirt and container are turned in one direction but permit the annular teeth to slide past one another when the slip skirt and container are turned in the opposite direction. In safety container 140 the placing of a step in the top of container bottom 143 for teeth 152 holds slip skirt 142 in position at the top of container 143. In the invention of FIG. 4 the sleeve portion 142 is generally made long enough to have sufficient space for the user to grasp the top of the container and comfortably squeeze on the pressure regions 155 and 156.

In order for the user to prevent rotation of slip skirt 142 when the user loosens cover 141 there are provided a pair of brake regions 149 and 157 on the interior of container 142. FIG. 4 shows a brake region 149 which is defined by a groove 150. Located on the interior of container 143 is a second brake region 157 that is defined by an identical groove 150*a* located on the opposite side of container 143. Located outside and at the top of container 143 are two diametrically opposite regions 155 and 156 that define pressure regions that a user squeezes on to prevent rotation of slip skirt 142 as cap 141 is unscrewed. FIG. 6 illustrates how radial inward pressure on region 156 forces friction pad 149 into contact with friction band 148 to prevent rotation of slip skirt 142. Similarly, the identical friction pad 157 located diametrically opposite from pressure pad 156 permits the frictional grasping of frictional pad 148 from two diametrically opposite locations.

To open safety container 140 the user merely grasps container 143 in the pressure regions 155 and 156 and squeezes with the finger and thumb at the pressure regions 155 and 156 while using the other hand to unscrew cover 141. To close safety container 112 is simpler since the user does not have to hold container 143 in any particular orientation because the one way ratchet teeth 153 and 152 engage each other to prevent free rotation of sleeve 142 when cover 141 is turned on.

Figure 7:
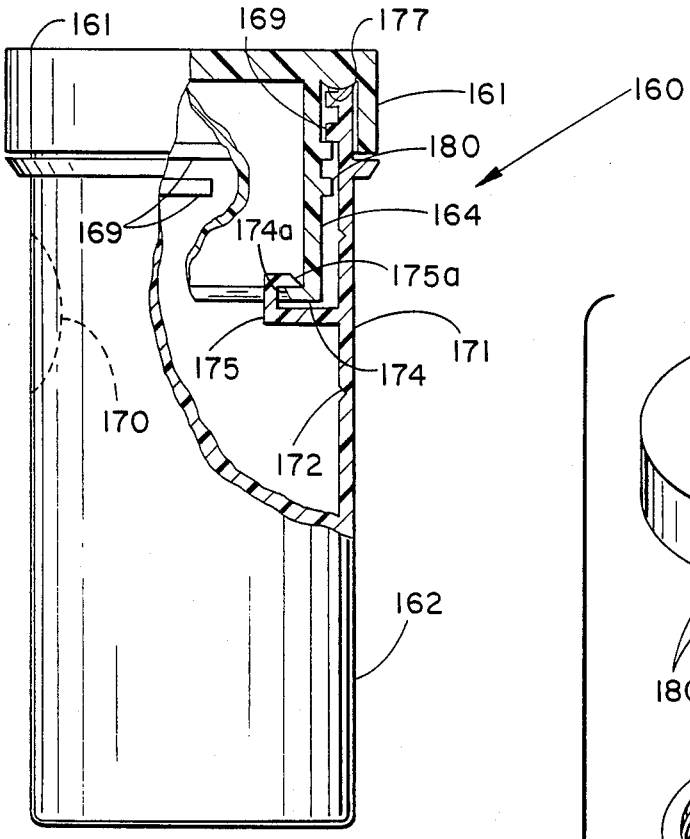
FIG. 7 shows a partial sectional view of a further embodiment of my invention.
Figure 8:
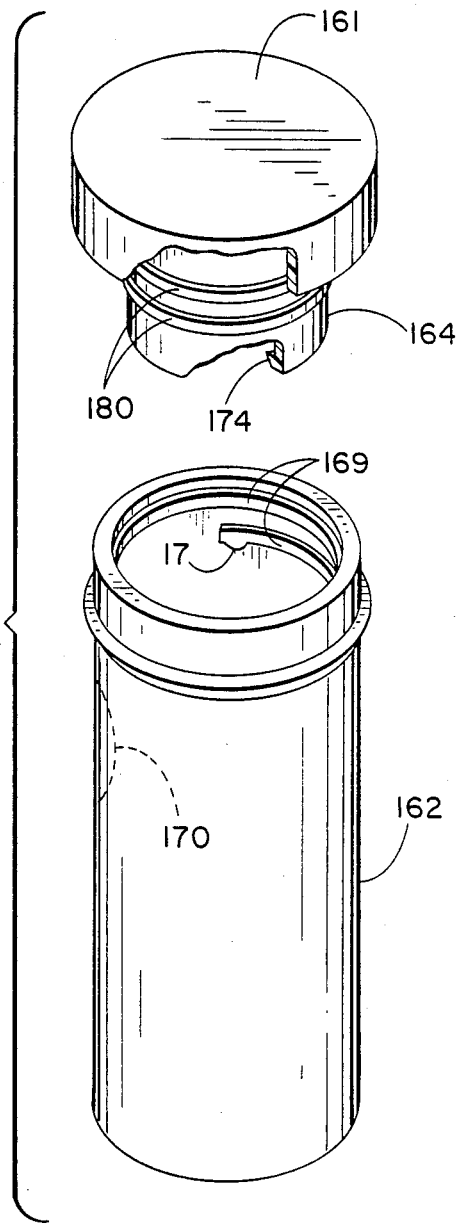
FIG. 8 shows an exploded view of the of FIG. 7.

Referring to FIG. 7 and FIG. 8 reference numeral 160 identifies an alternate embodiment of safety container 160 which comprises a cylindrical cover 161 and a cylindrical container 162. Cover 161 includes a cylindrical slip skirt 164 having a set of external threads 180 and an annular lip 174 for engaging latch lips on container 162. Safety container 160 like safety containers 110 and 140 also uses an interior cylindrical slip skirt that only extends partially into the top of container 162.

Container 162 includes a set of internal threads 169 for engaging threads 180 to permit the user to open and close safety container 160. Container 162 includes a first external pressure region 170 and a second external pressure region 171 that is located diagonally opposite of each other. Located around pressure region 171 is a groove 172 that forms a weakened area to permit the pressure region 171 to move radially inward in response to finger pressure on pressure region 171. Similarly, located around pressure region 170 is an identical groove (not shown) that also forms a weakened area to permit the pressure region 170 to move radially inward in response to finger pressure on pressure region 170.

Located behind pressure region 171 is a latch lip 175 that forms locking engagement of cover 161 with container 162 when the cover is screwed on container 162. Similarly, located behind pressure region 170 is an identical latch lip (not shown) that forms locking engagement of cover 161 with container 162 when the cover is screwed on container 162.

Figure 9:
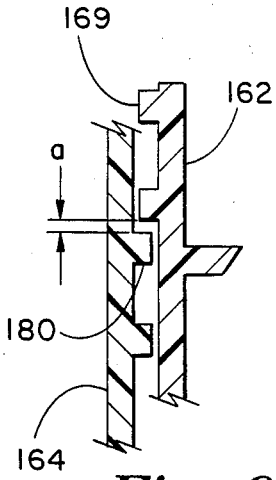
FIG. 9 shows an enlarged portion of FIG. 7.

In order for one to close cover 161 one merely turns cover 161 until cover 161 begins to turn with very little resistance. That is, as cover 161 is screwed down it forces the beveled surface 175*a* of latch lip 175 and its counterpart over the beveled edge 174*a* of annular lip 174. Typically, the containers of my inventions are made from a polymer plastic and the latch lip members have sufficient resiliency to flex to permit annular member 175 to easily force itself past the latch lips and into locking engagement with the latch lips but sufficiently rigid to prevent withdrawal if there are no beveled mating surfaces. In the closing action the rotation of cover 161 in combination with threads 169 and a ramp 177 located on the underside of threads 169 force skirt into engagement with latch lips on the container 162. Ramp member 179 (FIG. 8) is located on the underside of internal threads 169 and engages the top of threads 165 after threads 180 and 169 disenengage to continue to force sleeve 164 downward as cover 161 is turned on. That is, as cover 161 is rotated the top of threads 165 contact ramp 179 and force annular lip 165 into engagement with latch lips. In the latched condition there is a slight clearance "a" (FIG. 9) between teeth 169 and 180 thus preventing engagement of threads 165 and 180 if the user should attempt to loosen cover 161. Once annular lip member 174 is in engagement with the latch lips the rotation of cover 161 in either direction will not loosen the cover since threads 169 are held in a spaced condition from threads 180 to prevent engagement of each other. As long as annular lip 175 engages the latch lips it is impossible for threads 180 and 169 to engage each other to permit removal of cover 161. To open container 160 the user places a finger and thumb on the outside of the container and squeezes on the pressure regions 170 and 171 while turning cover 160. The inward force on pressure regions 170 and 171 releases latch lips from annular member 165 while an annular resilient member 177 located in the cover provides a normal upward force on cover 161 thus automatically forcing cover 161 up until the top portion of threads 180 engage threads 169. When the threads engage each other the user merely continues to rotate the cover until the cover is free from container 162. In safety container 160 I use the mechanical advantage of the screw threads to force the annular lip past the latch lips while in safety container 110 the user must supply the necessary force to force the annular lip into latching engagement with the latch lips. Safety containers 110 and 160 differ from other safety container since the finger and thumb pressure is used to unlatch the cap rather than prevent rotation of an inner cylindrical member.

Figure 10:
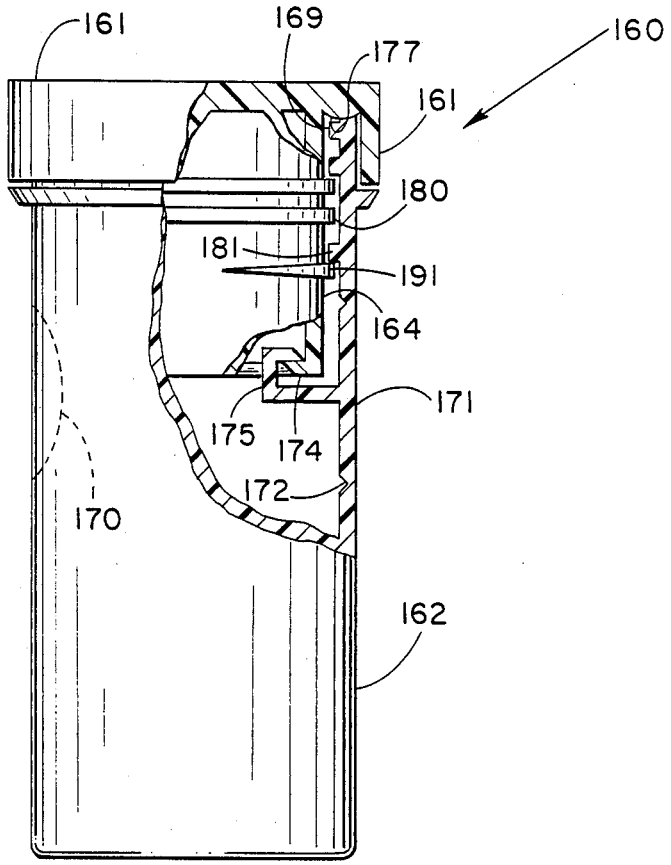
FIG. 10 shows an alternate embodiment of a locking mechanism.

Referring to FIG. 10, I show an alternate embodiment of safety container 160 that includes a tooth 181 that projects inward from one side of container 162 to engage a tapered ramp 191 located on the outside of sleeve skirt 164. The engagement of ramp 191 and tooth 181 pulls sleeve 164 downward as threads 169 disengage from threads 180. Since ramp 191 only extends partially on sleeve 164, it can only pull sleeve skirt 164 downward to provide engagement of the latch lips and annular lip. A similar tooth (not shown) can be located on the opposite of container to engage ramp 191 as the sleeve 164 is rotated. With two teeth on container 162 I can pull sleeve 164 downward from opposite sides of container 162.

It is apparent that the embodiments of FIGS. 1 to 10 show a safety container having the release mechanism located at the topmost portion of the container. The location of the latching means and the release mechanism at the top portion of the container provides a double benefit in that it removes the latching mechanism from the region where the medication is usually located and it also reduces the amount of material necessary to make the invention since a slip ring or cylindrical insert is used in place of an interior container.

The embodiments previously disclosed in my copending application are shown in FIGS. 11–20.

Figure 11:
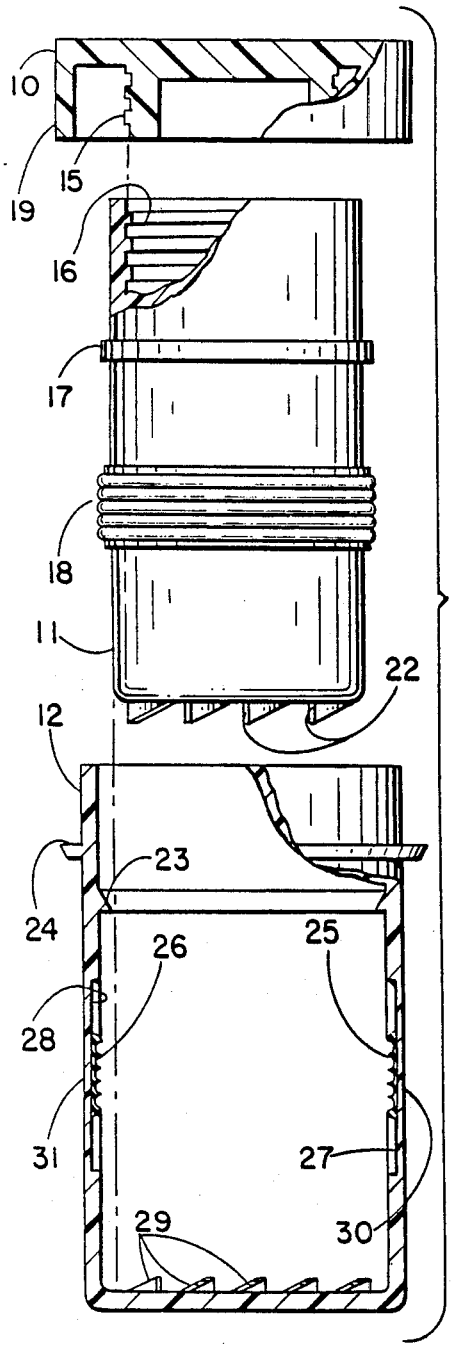
FIG. 11 is an exploded view of my safety container.

Referring to FIG. 11, reference numeral 10 generally identifies the screw-on cover that has an annular lip 19 that freely rotates about the outside of container 12. Reference numeral 11 identifies the inner medicine container and reference numeral 12 identifies the outer container which the user grasps and squeezes in specific locations during the opening process. Cover 10 has threads 15 which frictionally engage mating threads 16 located on inner container 11 to frictionally hold cover 10 on container 11. Located on the side of inner container 11 is a circumferential ring 17 that fits under a circumferential tapered lip stop 23 that prevents inner container 11 from being removed from outer container 12 once inner container 11 is slid into container 12. That is, lip 23 and containers 11 and 12 have sufficient flexibility that inner container 11 can be inserted in outer container 12 by forcing ring 17 downward over tapered lip 23. The diameter of inner container 11 is of sufficient size so that there is a slight clearance between the outside diameter of inner container 11 and the inside diameter of outer container 12 to permit free rotation of container 11 within container 12 when a user grasps and turns cover 10 on container 11. When used as a container for medication the container 9 is made of a polymer plastic such as styrene or the like, however, other suitable materials are usable with my invention.

In order to prevent inner container 11 from rotating when cover 10 is rotated, I provide means on container 11 and container 12 to frictionally engage one another so the user can prevent rotation of inner container 11 by grasping and applying pressure in selected regions on outer container 12. Container 11 includes a cylindrical band 18 comprised of a plurality of spaced, parallel, convex ridges which are made on the outside surface of the inner eontainer 11. In an alternate embodiment the cylindrical band could be made of a frictional material such as rubber or the like and fitted directly to the outside of inner container 11. Container 12 has a pair of circular friction pads 25 and 26 which are located diametrically opposite of each other on the inside of outer container 12. Located around friction pad 25 is an annular resilient flexing region 27 that permits friction pad 25 to move inward when pressure is applied to circular region 30 located and marked on the outside of outer container 12. Similarly, located on the opposite side of container 12 is an annular resilient flexing region 28 that permits friction pad 26 to move inward when pressure is applied to circular region 31 located and marked on the outside of outer container 12. The marking on the outside could be a colored dot or the like that directs the user's fingers to the area which must be squeezed to open the container. The simultaneous inward pressure on regions 30 and 31 forces friction pads 25 and 26 radially inward to engage friction band 18. The engagement of friction pads 25 and 26 with friction band 18 prevents rotation of inner container 11 with respect to container 12 to permit a user to unscrew cover 10 by turning cover 10 when holding and squeezing on specific regions 30 and 31 on the outside of outer container 12.

It should be noted that the present invention provides for resilient flexing regions 27 and 28 which are regions that have less strength than the rest of the container which in effect creates a container having a "weak spot" that makes it relatively easy for an elderly person to open the container since very little squeezing force is required to squeeze container 12. Although very little force is required to force friction pads 25 and 26 into engagement with friction band 18, it is difficult for a young child to perform the squeezing and holding function since the young child must know that squeezing and holding is required in specific regions on the outside of container 12. In addition, since the large motor skills of young children (such as hand grasping actions) predominate over small motor skills such as applying finger pressure, it is very difficult for a young child to provide both the squeezing and holding action necessary to open container 11. The normal motor action for the child is to grasp container 12 with the entire hand and not to apply pressure on specific regions of the container. Consequently, container 11 freely rotates within container 12 thus preventing the child from removing the cover from container 11.

FIG. 19 shows an enlarged view of friction pad 25 and cylindrical brake 18 which is molded directly in the side of container 12. Band 18 comprises a set of annular convex ridges 41 that are located next to each other in a parallel arrangement separated by annular grooves 43. Friction pad 25 has a mating surface with concave sections 40 that engage the convex portions 41 when pad 25 is squeezed against band 12. Friction pad 25 also has ridges 42 that engage the grooves 43 in band 18. The use of mating surfaces that have a contoured shape are preferred to surfaces that are not contoured since the use of contoured surfaces produces greater surface area contact for a given length of friction pad. In addition, the use of ridges 22 forms an interfering engagement with grooves 43 to provide an almost pinching effect to enhance the braking resistance. The friction pad 26 is identical to friction pad 25 and will not be described.

Figure 12:
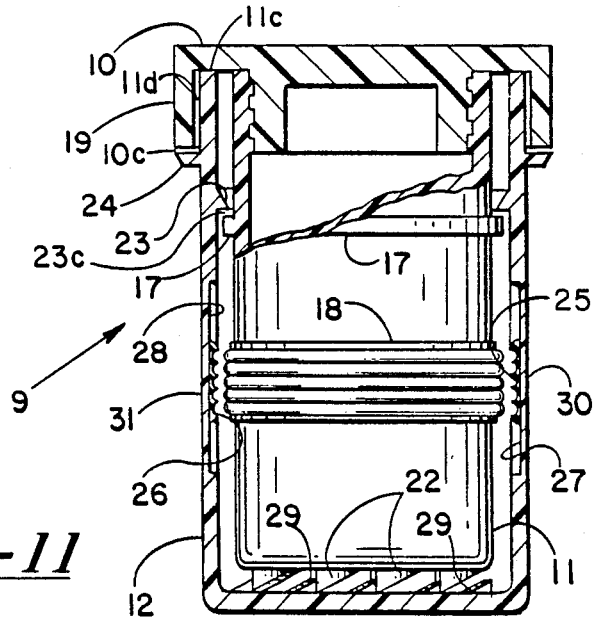
FIG. 12 is a side sectional view of my safety container in an assembled condition.

Referring to FIG. 12 container 9 is shown in the assembled condition with inner container 11 located inside outer container 12. In the assembled condition inner container 11 is free to rotate with cover 10 if the user merely grasps outer container 12 and attempts to unscrew cover 10. The circular lip 23 is spaced a distance 23*c* from circular ridge 17 which prevents withdrawal of inner container 11 from outer container 12. The spacing of lip 23 from ridge 17 permits inner container 11 to axially tip or laterally slide within the confines of outside container 12. If inner container 11 is permitted to tip axially, it is necessary to have pressure on both squeeze regions 30 and 31 in order to prevent rotation of inner container 11. If inner container 11 were not permitted to tip slightly axially, it may be possible for pressure on only one specific region to prevent rotation of the inner container. However, with inner container 11 being able to tip axially insures that the outside of the container 12 must be squeezed in two specific regions to prevent free rotation of inner container. In addition, cover 10 is spaced a distance 11*d* from container to permit the axially tipping or displacement of inner container should pressure be applied to only one specific region on the outside of container 12.

FIG 12 also shows that cover 10 engages area 11*c* on container to prevent a child from pushing down on cover 10 in an attempt to stop the rotation of inner container 11.

To permit closing of container 9 without any special holding action on the user, I provide an annular set of ratchet teeth 22 on the bottom of inner container 11 that engages a similar annular set of smaller mating ratchet teeth 29 to prevent rotation of container 11 with respect to container 12 when cover 10 is tightened but slip past each other when the cover 10 is turned in the direction to loosen the cover. Ratchet teeth 22 and ratchet teeth 29 thus coact with each other to prevent rotation of container 11 with respect to container 12 when cover 10 is tightened but not when cover 10 is loosened. If desired, the same holding and squeezing action could be employed for the closing of cover 10, however, the use of ratchet teeth that only function when the cover 10 is opened makes it somewhat easier for an elderly person to use the container.

Figure 15:
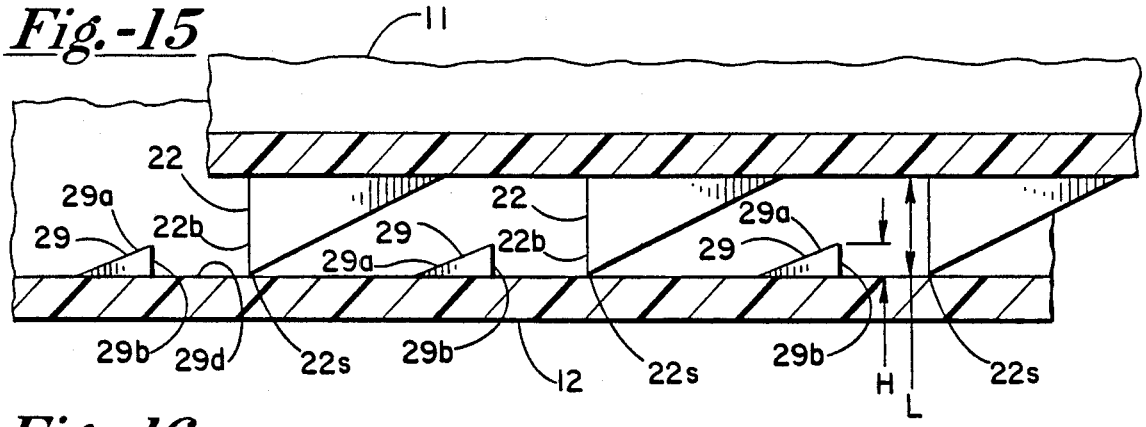
FIG. 15 is an enlarged view of the teeth on the containers that permit rotation in one direction and prevent rotation in the opposite direction.

The detail and the operation of ratchet teeth 22 and 29 is illustrated in FIGS. 15 through 18. FIG. 15 shows ratchet teeth 22 located in the flat region 29*d* between adjacent teeth 29. Ratchet teeth 29 have a height designated by L and ratchet teeth 29 have a height designated by *h*. Ratchet teeth 29 have a ramped or angled top surface 29*a* and a rear surface 29*b*. Similarly, ratchet teeth 22 have a ramped or angled surface and a backside surface 22*b*. The tip of ratchet teeth 22 is designated by reference numeral 22*s* and constitutes the region of teeth 22 that engage the surface 29*a* on teeth 29 as the inside container is rotated with respect to the outside container 12.

Figure 16:
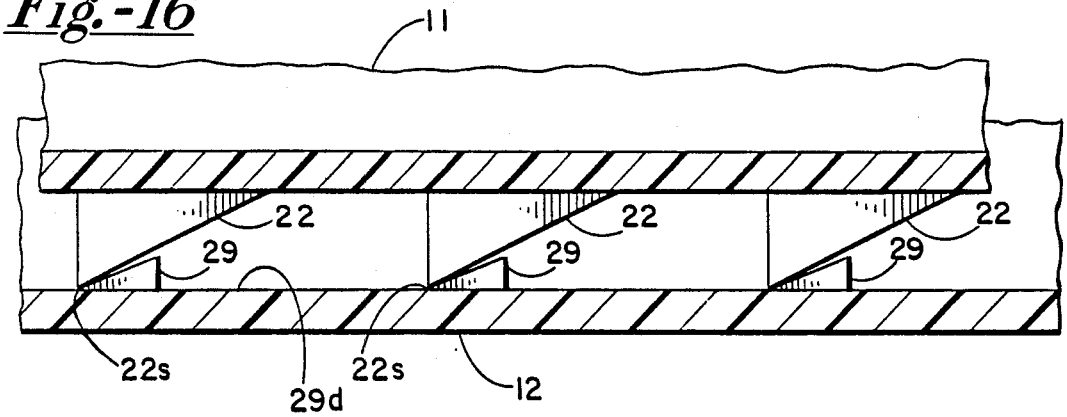
FIG. 16 show the container teeth as they are about to slide over each other.

FIG. 16 illustrates the position of teeth 29 and 22 as the ramped portion of the teeth begin to engage each other. It should be noted that the angle on teeth 29 is different from the angle on teeth 22 so that only a small portion 22*s* will engage teeth 29. The reason the surface area contact between teeth 29 and 22 is kept to a minimum is to reduce the frictional drag between inner container 11 and outer container 12. That is, when one grasps cover 10 and container 12 one wants to be assured that the frictional drag between the two containers is insufficient to prevent free rotation between the two containers.

Figure 17:
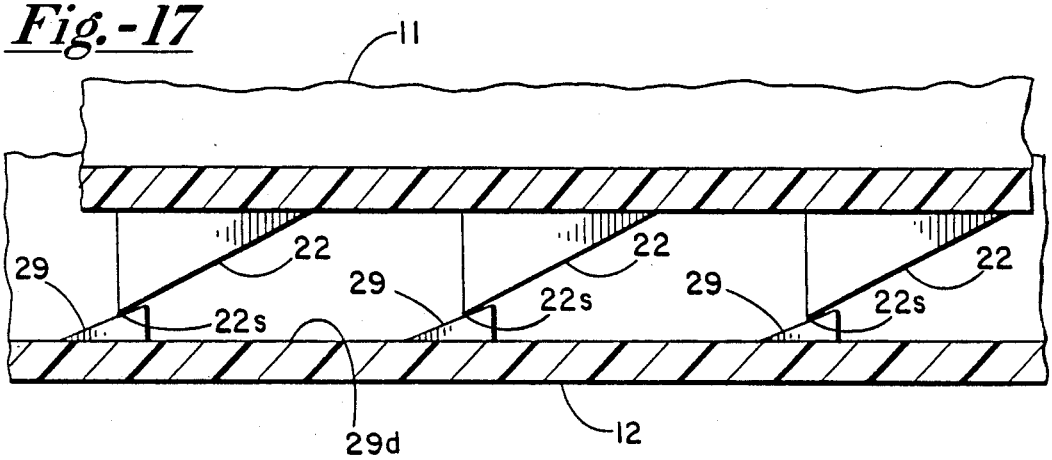
FIG. 17 show the container teeth as they are sliding past each other.

FIG. 17 illustrates the position of ratchet teeth 29 and 22 as teeth 22 pass over teeth 29. Note, container 11 is displaced upward slightly to permit teeth 22 to ride over teeth 29.

Figure 18:
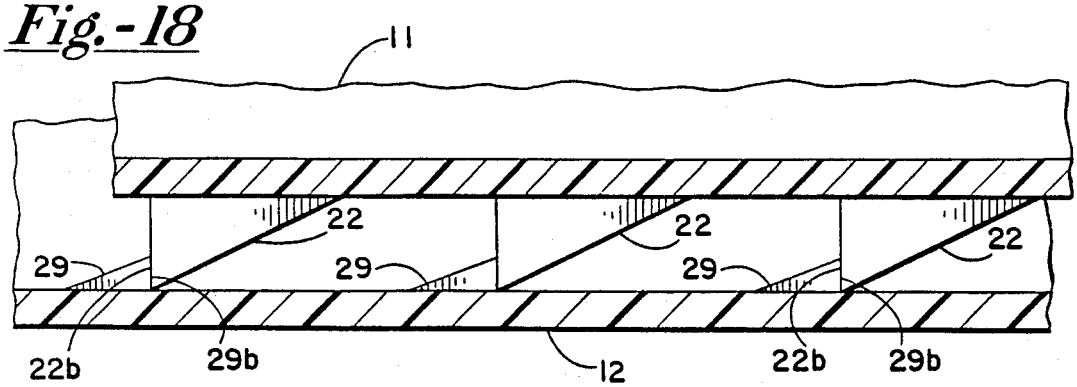
FIG. 18 shows the container teeth in the locked positon to permit closing of the container.

FIG. 18 shows teeth 29 and 22 with surfaces 29*b* and 22*b* in engagement with each other. In this position container 11 and container 12 cannot rotate past each other in one direction but they can rotate past each other in the opposite direction. Consequently, the one-way action of teeth 22 and 29 is such that container 11 can be held with container 12 without having to squeeze outer container 12. This enables the user to tightly close cover 10 on container 11. However, since the teeth slide past each other in the opposite direction of rotation, one must grasp and hold container 12 in the specific regions 30 and 31 to prevent rotation of inner container 11.

Figure 13:
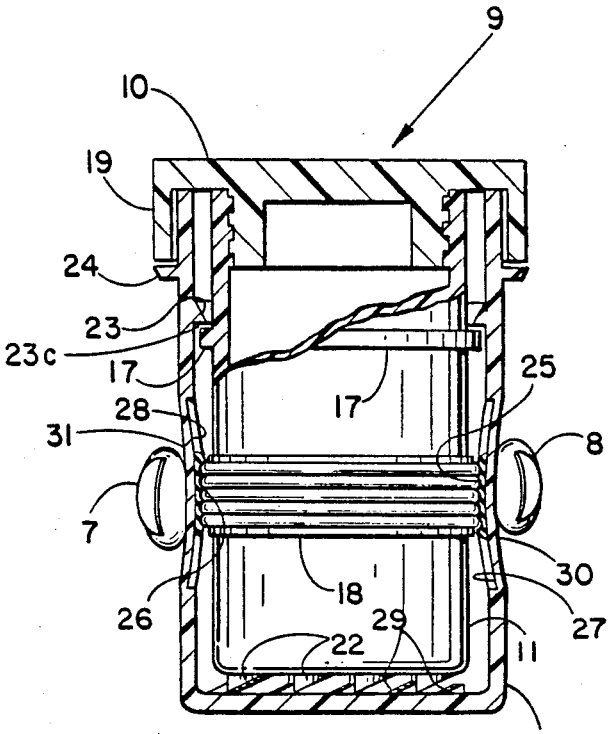
FIG. 13 shows a side sectional view of my safety container with the sides of the outer container engaging the friction ring on the inner container.

FIG 13. shows container 9 with a user's thumb 8 and a finger 7 grasping and holding friction pads 25 and 26 in contact with friction band 18. The user's thumb 8 is located on pressure region 30 and the user's finger 7 is located on pressure region 31 in a grasping manner that a user is accustomed to in opening similar containers without tamper resistant features.

Figure 14:
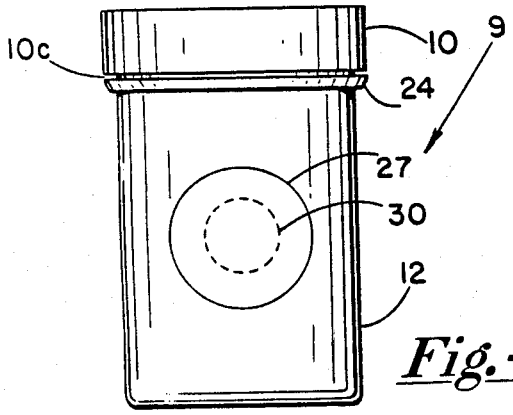
FIG. 14 shows an exterior front view front view of my safety container.

FIG. 14 shows a side view of container 9 revealing the marked pressure region 30 where the user squeezes to force friction pad 25 against friction band 18. A similar region 31 is marked on the diametrically opposite side of outer container 12 so that the squeezing action between the finger and thumb simultaneously forces both friction pads 25 and 26 to engage friction band 18. In the preferred embodiment pressure regions 30 and 31 are flush with the exterior of container 12 so as not to direct the child's attention to a raised area that might require squeezing.

Friction pads 25 or 26 have sufficiently small area so that the normal squeezing pressures applied to only one region is insufficient to restrain container 11 from rotating within container 12 as one attempts to unscrew cover 10. If the pressure is applied simultaneously to both regions 30 and 31, the combination of squeezing from both sides ensures that the inner container 11 can be restrained from rotation to permit one to unscrew cover on inner container 11. FIG. 4 also shows a lip 24 on the outside of container 12 that mates with the lower edge of lip 19 of cover 10 to prevent a youngster from inserting a tool underneath the cover to pry off cover 10.

FIG. 20 illustrates how my tamper resistant container 9 is held and grasped with thumb 8 and finger 7 as a user uses the left hand 6 to remove cover 10.

While inner container 11 is shown with a closed bottom to contain toxic substances, one could remove the bottom from container 11 and use the bottom of container 12 as the bottom of the container 9 and the cylindrical sides of container 11 as the cylindrical sides of container 9.

I claim:

1. A tamper resistant container that can be readily opened by an elderly person but is difficult for a young child to open comprising:

a container for holding toxic substances, said container having an inside and an outside and a top, said container having a threaded section for engaging a cover and a pressure region;

a cover having a threaded section for engaging said container to close and seal toxic substances in said container, said container including means to permit free rotation of said container when said cover on said container is rotated in a direction to unscrew said cover to thereby thwart a young child from opening said tamper resistant container, said cover including latching means located at the top of said container to latch said cover to said container, said latching means operable for disengagement of said cover with said container by the user squeezing on a specific region on the outside of said container so that said latching means disengages from said cover to thereby permit the user to unscrew said cover from said container.

2. The tamper resistant container of claim 1 wherein said latching means comprises a cylindrical skirt located on said cover and a pair of latch lips located on said container.

3. The tamper resistant container of claim 2 wherein said pressure region comprises a pair of oval regions marked on the top, outside portion of said container.

4. The tamper resistant container of claim 3 wherein said container includes a resilient flexing region located beneath said pressure regions to permit a user to disengage said latching means by squeezing inward on said pressure regions on the outside of said container.

5. The tamper resistant container of claim 4 wherein said container includes a ramp to force said latching means into locking engagement.

6. A tamper resistant container that can be readily opened by an elderly person but is difficult for a young child to open comprising:

a container for holding toxic substances, said container having an inside and an outside and a top, said container having a latch lip for engaging a cover and a pressure region located at the top of said container and over said latch lip;

a cover for engaging said container to close and seal toxic substances in said container, said container including means to permit free rotation of said container when said cover on said container is rotated to thereby thwart a young child from opening said tamper resistant container, said cover including a cylindrical lip to latch said cover to said container, said cylindrical lip operable for disengagement of said cover with said container by the user squeezing on a specific region on the outside of said container so that said container flexes inward to disengage said cylindrical lip from said container to thereby permit the user to remove said cover from said container.

7. The tamper resistant container of claim 6 wherein said specfic regions comprise resilient flexing regions have an oval shape to provide a weak spot on said container to facilitate an elderly person to disengage said latching means.

8. The tamper resistant container of claim 7 wherein said cover has an outer lip and said container has a bright marking with said outer lip extending over said bright marking when said cover is in a closed position to therby visually alert a user when the cover is not on said container.

9. The tamper resistant container of claim 8 wherein said tamper resistant container is made of a polymer plastic.

10. A tamper resistant container that is difficult for a youngster to open but can readily be opened by an elderly person even though the youngster may have greater physical strength than the elderly person comprising:

a cylindrical insert;

a screw-on cover located on said cylindrical insert;

a container, said cylindrical insert rotatable mounted in said container to prevent a youngster from removing said cover through rotation of said cover while grasping said container, means for prevention of rotation of said cylindrical insert with respect to said container when said container is held and squeezed between the user's finger and thumb of one hand so that when the user rotates the cover with the other hand the cover can be removed from said container.

11. The tamper resistant container of claim 10 wherein said means for prevention of rotation of said cylindrical skirt are located near the top of said container.

12. The tamper resistant container of claim 11 wherein said means includes a friction band located on said cylindrical skirt and friction pads located on said container.

13. The tamper resistant container of claim 12 wherein said cylindrical skirt has a ridge to engage a ridge on said container to prevent said cylindrical skirt from being withdrawn from said container.

14. A tamper resistant container that can be readily opened by an elderly person but is difficult for a young child to open comprising:

a container for holding toxic substances, said container having an inside and an outside and a top, said container having a first latch lip and a second latch lip for engaging a cover, said first latch lip and said second latch lip located on the inside of said container, said container including a first pressure region located on the outside of said container and directly opposite of said first latch lip, said container including a second pressure region located on the outside of said container and directly opposite of said second latch lip, said first pressure region and said second pressure region operable for flexing inward in response to a user squeezing on said first pressure region and said second pressure region;

a cover for engagment and disengagement with said container to permit removal of said cover from said container; said cover and said container operable to close and seal toxic substances in said container, said cover including a third lip to latch said third lip of said cover to said first lip of said container, said cover including a fourth lip to latch said fourth lip of said cover to said second lip of said container, said cover operable for disengagement with said container by the user simultaneously squeezing on said first pressure region and said second pressure region on the outside of said container so that said container flexes inward at said first pressure region to release said first latch from said third latch and said second latch from said fourth latch thereby disengaging said cover from said container to hereby permit the user to remove said cover from said container.

* * * * *